US012595799B2

(12) United States Patent
Honda et al.

(10) Patent No.: US 12,595,799 B2
(45) Date of Patent: Apr. 7, 2026

(54) METHOD OF STARTING AND STOPPING PUMP APPARATUSES COUPLED IN SERIES

(71) Applicant: EBARA CORPORATION, Tokyo (JP)

(72) Inventors: Shuichiro Honda, Tokyo (JP); Tetsuji Kasatani, Tokyo (JP); Hayato Ikeda, Tokyo (JP); Kei Wataji, Tokyo (JP); Hyuga Kikuchi, Tokyo (JP); Mitsutaka Iwami, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/867,622

(22) PCT Filed: May 15, 2023

(86) PCT No.: PCT/JP2023/018086
§ 371 (c)(1),
(2) Date: Nov. 20, 2024

(87) PCT Pub. No.: WO2023/228792
PCT Pub. Date: Nov. 30, 2023

(65) Prior Publication Data

US 2025/0341215 A1 Nov. 6, 2025

(30) Foreign Application Priority Data

May 26, 2022 (JP) ..... 2022-085897

(51) Int. Cl.

| | |
|---|---|
| ***F04D 15/02*** | (2006.01) |
| ***F04D 7/04*** | (2006.01) |
| ***F04D 15/00*** | (2006.01) |

(52) U.S. Cl.
CPC ..... *F04D 15/02* (2013.01); *F04D 15/0011* (2013.01); *F04D 7/04* (2013.01); *F04D 15/029* (2013.01)

(58) Field of Classification Search
CPC ..... F04D 15/0011; F04D 15/0077; F04D 15/0083; F04D 15/02; F04D 15/029; F04D 7/02; F04D 7/04
See application file for complete search history.

(56) References Cited

FOREIGN PATENT DOCUMENTS

| | | |
|---|---|---|
| JP | S59-159795 A | 10/1984 |
| JP | S62-31680 A | 8/1987 |

(Continued)

OTHER PUBLICATIONS

English machine translation of DE 10 2014 222 962 A1, Oct. 23, 2025.*

(Continued)

*Primary Examiner* — Christopher Verdier
(74) *Attorney, Agent, or Firm* — Chrisman Gallo Tochtrop LLC

(57) ABSTRACT

A method of starting a submersible pump used for transferring liquefied gas. The method includes starting a submersible pump (1A) disposed in a suction container (2A) of a pump apparatus (100A) to deliver liquefied gas to a suction container (2B) of a pump apparatus (100B) through a flow-path switching device (5A) in the suction container (2A), passing the liquefied gas through a flow-path switching device (5B) in the suction container (2B) while the liquefied gas bypasses a submersible pump (1B) disposed in the suction container (2B), and then starting the submersible pump (1B).

10 Claims, 12 Drawing Sheets

(56) References Cited

FOREIGN PATENT DOCUMENTS

| | | | |
|---|---|---|---|
| JP | 06-307376 | A | 11/1994 |
| WO | 2022/113450 | A1 | 6/2022 |

OTHER PUBLICATIONS

English machine translation of WO 2022/113450A1, Oct. 23, 2025.*
International Search Report issued in Patent Application No. PCT/JP2023/018086 dated Jul. 25, 2023.

* cited by examiner

-- PRIOR ART --

METHOD OF STARTING AND STOPPING PUMP APPARATUSES COUPLED IN SERIES

TECHNICAL FIELD

The present invention relates to a method of starting and stopping a submersible pump used for delivering liquefied gas, such as liquid hydrogen, liquid nitrogen, liquefied ammonia, liquefied natural gas, liquefied ethylene gas, or liquefied petroleum gas, and in particular to a technique of starting and stopping a submersible pump while preventing rotation of an impeller of another submersible pump that is not in operation.

BACKGROUND ART

Natural gas is widely used for thermal power generation and used as a raw material for chemicals. Furthermore, hydrogen is expected to be an energy that does not generate carbon dioxide that causes global warming. Applications of hydrogen as an energy include fuel cell and turbine power generation. Natural gas and hydrogen are in a gaseous state at normal temperature, and therefore natural gas and hydrogen are cooled and liquefied for their storage and transportation. Liquefied gas, such as liquefied natural gas (LNG) or liquid hydrogen, is temporarily stored in a liquefied-gas storage tank and then delivered to a power plant, factory, or the like by a pump.

FIG. 11 is a schematic diagram showing a conventional example of a pump apparatus for pumping up the liquefied gas. A pump 500 is installed in a vertical suction container 505 coupled to a liquefied-gas storage tank (not shown) in which the liquefied gas is stored. The liquefied gas is introduced into the suction container 505 through a suction port 501, and the suction container 505 is filled with the liquefied gas. The entire pump 500 is immersed in the liquefied gas. Therefore, the pump 500 is a submersible pump that can operate in the liquefied gas. When the pump 500 is in operation, the liquefied gas is discharged by the pump 500 through a discharge port 502. During the operation of the pump 500, a part of the liquefied gas in the suction container 505 is vaporized into gas, and this gas is discharged from the suction container 505 through a vent line 503.

In order to pressurize the liquefied gas to target pressure required for a user, multiple pump apparatuses may be coupled in series as shown in FIG. 12. The liquefied gas is sequentially pressurized by pumps 500 of the multiple pump apparatuses. When the plurality of pump apparatuses are to be started, the pumps 500 are started sequentially in the order from the upstream pump. When the plurality of pump apparatuses are to be stopped, the pumps 500 are stopped sequentially in the order from the downstream pump.

CITATION LIST

Patent Literature

Patent document 1: Japanese laid-open utility model publication No. S59-159795

Patent document 2: Japanese examined utility model application publication No. S62-031680

SUMMARY OF INVENTION

Technical Problem

However, when the pump apparatuses coupled in series are started or stopped in sequence, the following problem occurs. When a first pump 500 is started, a flow of liquefied gas is generated in a stopped pump 500. As a result, an impeller of the stopped pump 500 is forced to rotate, and sliding parts, such as bearings, may be damaged.

When the pump 500 is operating, the liquefied gas is pressurized by the rotation of the impeller. Therefore, a thrust balance mechanism of the pump 500 works and no excessive load is applied to the sliding parts, such as bearings. However, when the pump 500 is not in operation, the thrust balance mechanism does not work. As a result, the liquefied gas delivered from the other pump 500 forcibly rotates the impeller, resulting in damage to the sliding parts, such as the bearings. In particular, the liquefied gas has a low viscosity, and the sliding parts, such as the bearings, are easily worn out by the unintended rotation of the impeller. Furthermore, when the operation of the downstream pump 500 is stopped, the same problem may happen because the upstream pump 500 is still operating. In addition, when the pump 500 is suddenly stopped due to malfunction of the pump 500, the same problem may happen.

Therefore, the present invention provides a method of starting and stopping a submersible pump among a plurality of submersible pumps coupled in series, while preventing rotation of an impeller of another submersible pump that is not in operation.

Solution to Problem

In an embodiment, there is provided a method of starting a plurality of pump apparatuses including at least a first pump apparatus and a second pump apparatus coupled in series, comprising: starting a first submersible pump arranged in a first suction container of the first pump apparatus to deliver liquefied gas through a first flow-path switching device arranged in the first suction container to a second suction container of the second pump apparatus; passing the liquefied gas through a second flow-path switching device arranged in the second suction container while the liquefied gas bypasses a second submersible pump arranged in the second suction container; and then starting the second submersible pump.

In an embodiment, each of the first flow-path switching device and the second flow-path switching device includes: a flow-passage structure having a pump-side flow passage, a container-side flow passage, and an outlet flow passage; and a valve element arranged in the flow-passage structure, the valve element being configured to allow the outlet flow passage to selectively communicate with either the pump-side flow passage or the container-side flow passage, the pump-side flow passage communicating with a discharge outlet of the corresponding submersible pump, the container-side flow passage communicating with an interior of the corresponding suction container, and the outlet flow passage communicating with a discharge port of the corresponding suction container.

In an embodiment, there is provided a method of stopping operations of a plurality of pump apparatuses including at least a first pump apparatus and a second pump apparatus coupled in series, comprising: while a first submersible pump arranged in a first suction container of the first pump apparatus is delivering liquefied gas through a first flow-path switching device arranged in the first suction container to a second suction container of the second pump apparatus, stopping operation of a second submersible pump arranged in the second suction container; passing the liquefied gas through a second flow-path switching device arranged in the second suction container while the liquefied gas bypasses the second submersible pump; and then stopping operation of the first submersible pump.

In an embodiment, each of the first flow-path switching device and the second flow-path switching device includes: a flow-passage structure having a pump-side flow passage, a container-side flow passage, and an outlet flow passage; and a valve element arranged in the flow-passage structure, the valve element being configured to allow the outlet flow passage to selectively communicate with either the pump-side flow passage or the container-side flow passage, the pump-side flow passage communicating with a discharge outlet of the corresponding submersible pump, the container-side flow passage communicating with an interior of the corresponding suction container, and the outlet flow passage communicating with a discharge port of the corresponding suction container.

Advantageous Effects of Invention

When a submersible pump is started or stopped, the flow-path switching device can allow the liquefied gas to bypass a submersible pump that is not in operation. Therefore, an impeller of the submersible pump that is not in operation does not rotate, and as a result, damage to sliding parts of the submersible pump, such as bearings, can be prevented.

DESCRIPTION OF EMBODIMENTS

Figure 1:
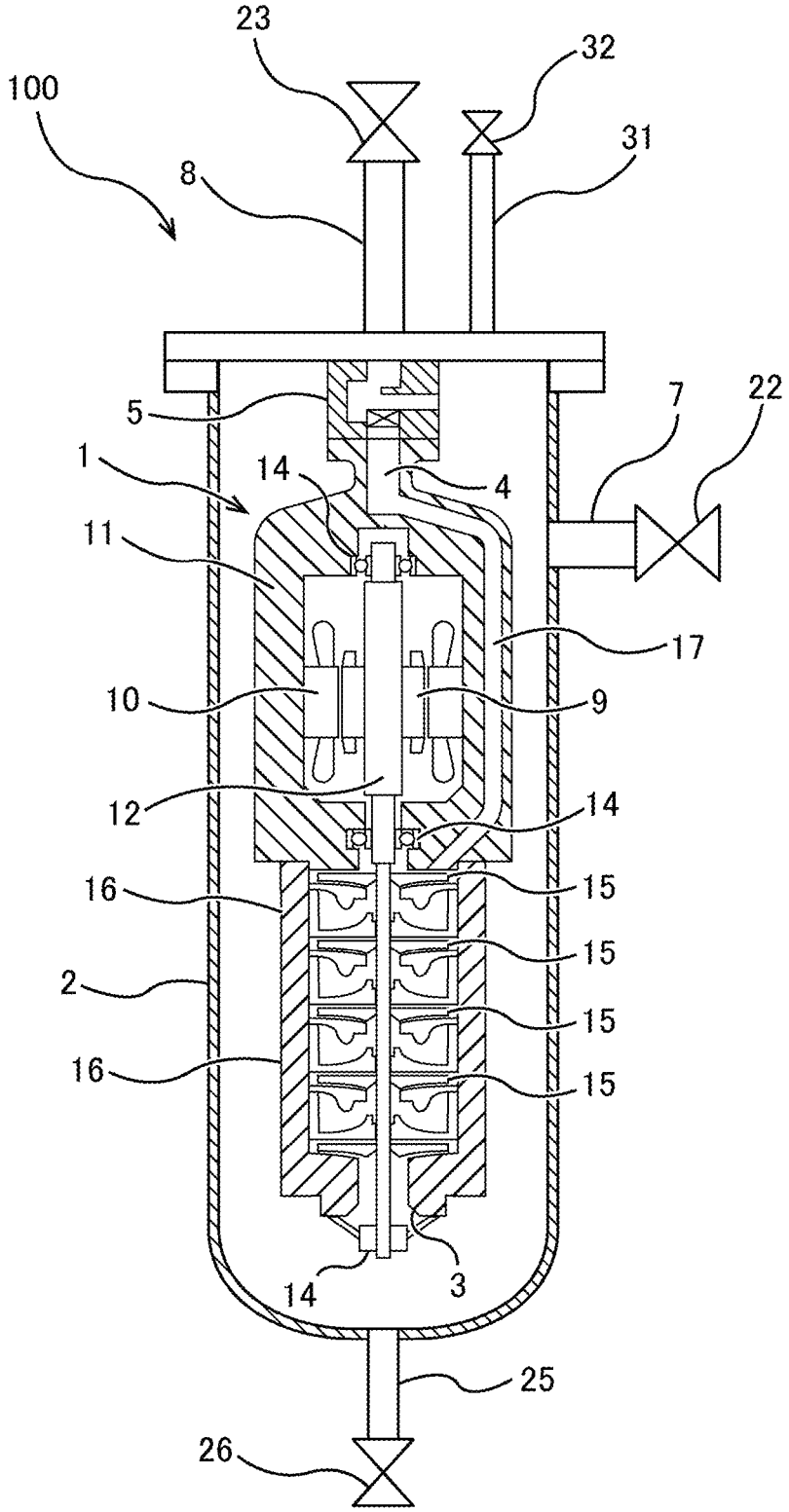
FIG. 1 is a diagram showing one embodiment of a pump apparatus for delivering liquefied gas.

Hereinafter, embodiments of the present invention will be described with reference to the drawings. FIG. 1 is a diagram showing an embodiment of a pump apparatus for delivering liquefied gas. Examples of liquefied gas to be delivered by a pump apparatus 100 shown in FIG. 1 include liquid hydrogen, liquid nitrogen, liquefied ammonia, liquefied natural gas, liquefied ethylene gas, and liquefied petroleum gas.

As shown in FIG. 1, the pump apparatus 100 includes a submersible pump 1 for delivering the liquefied gas, a suction container 2 in which the submersible pump 1 is accommodated, and a flow-path switching device 5 for preventing rotation of impellers 15 of the submersible pump 1 when the submersible pump 1 is not in operation. The suction container 2 has a suction port 7 and a discharge port 8. The liquefied gas is introduced into the suction container 2 through the suction port 7, and the suction container 2 is filled with the liquefied gas. During operation of the submersible pump 1, the entire submersible pump 1 is immersed in the liquefied gas. Therefore, the submersible pump 1 is configured to be able to operate in the liquefied gas.

The submersible pump 1 includes an electric motor 11 having a motor rotor 9 and a motor stator 10, a rotation shaft 12 coupled to the electric motor 11, a plurality of bearings 14 that rotatably support the rotation shaft 12, impellers 15 fixed to the rotation shaft 12, and a pump casing 16 in which the impellers 15 are housed. The flow-path switching device 5 is disposed in the suction container 2. More specifically, the flow-path switching device 5 is coupled to both a discharge outlet 4 of the submersible pump 1 and the discharge port 8 of the suction container 2. Specific configurations of the flow-path switching device 5 will be described later.

When electric power is supplied to the motor 11 through a power cable (not shown), the motor 11 rotates the rotation shaft 12 and the impellers 15 together. As the impellers 15 rotate, the liquefied gas is sucked into the submersible pump 1 through a suction inlet 3 and discharged into the flow-path switching device 5 through a discharge flow path 17 and the discharge outlet 4. The liquefied gas passes through the flow-path switching device 5 and is discharged through the discharge port 8 of the suction container 2.

A suction valve 22 is coupled to the suction port 7, and a discharge valve 23 is coupled to the discharge port 8. A drain line 25 is coupled to a bottom of the suction container 2, and a drain valve 26 is coupled to the drain line 25. The suction port 7 is provided on a side wall of the suction container 2 and is located higher than the bottom of the suction container 2. The discharge port 8 is provided on an upper portion of the suction container 2 and is located higher than the suction port 7. During operation of the submersible pump 1, the suction valve 22 and the discharge valve 23 are open, while the drain valve 26 is closed.

A vent line 31 is coupled to the upper portion of the suction container 2. During operation of the submersible pump 1, a part of the liquefied gas is vaporized into gas due to heat generation from the submersible pump 1, and this gas is discharged from the suction container 2 through the vent line 31. A vent valve 32 is coupled to the vent line 31. In one embodiment, this gas may be delivered to a gas treatment device (not shown) through the vent line 31. The gas treatment device is a device that treats gas (e.g., natural gas or hydrogen gas) vaporized from liquefied gas. Examples of the gas treatment device include a gas incinerator (flaring device), a chemical gas treatment device, and a gas adsorption device.

Figure 2:
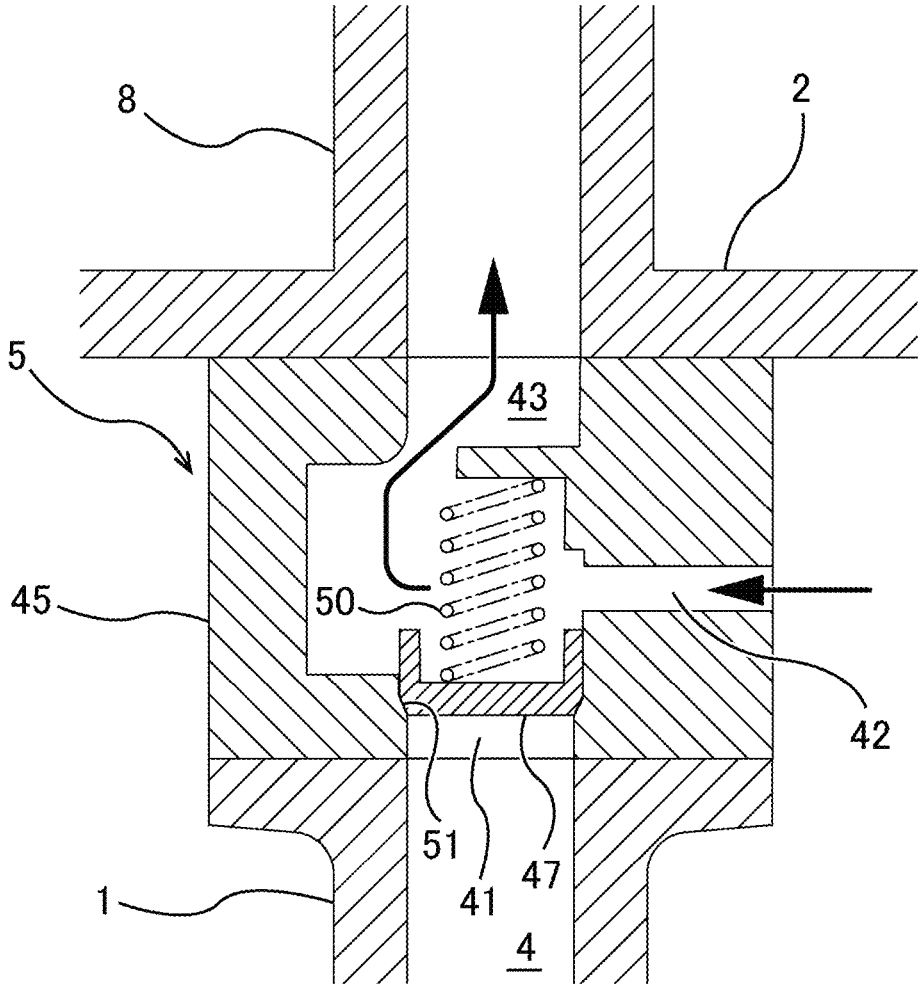
FIG. 2 is a cross-sectional view showing one embodiment of detailed configuration of a flow-path switching device.

FIG. 2 is a cross-sectional view showing an embodiment of detailed configuration of the flow-path switching device 5. As shown in FIG. 2, the flow-path switching device 5 includes a flow-passage structure 45 and a valve element 47 arranged in the flow-passage structure 45. The flow-passage structure 45 has a pump-side flow passage 41, a container-side flow passage 42, and an outlet flow passage 43 therein. The pump-side flow passage 41 communicates with the discharge outlet 4 of the submersible pump 1, the container-side flow passage 42 communicates with an interior of the suction container 2, and the outlet flow passage 43 communicates with the discharge port 8 of the suction container 2. The valve element 47 is arranged to allow the outlet flow passage 43 to selectively communicate with either the pump-side flow passage 41 or the container-side flow passage 42. The configuration of the flow-path switching device 5 is not limited to the embodiment shown in FIG. 2 as long as the flow-path switching device 5 can perform its intended function.

FIG. 2 shows a state of the flow-path switching device 5 when the submersible pump 1 is not in operation. The valve element 47 is pressed against the flow-passage structure 45 by a spring 50 to thereby close the pump-side flow passage 41. More specifically, the flow-passage structure 45 has a valve seat 51 formed around an outlet of the pump-side flow passage 41. The valve element 47 is pressed against the valve seat 51 by the spring 50. Therefore, when the valve element 47 is pressed against the valve seat 51, the pump-side flow passage 41 is closed, while the container-side flow passage 42 and the outlet flow passage 43 are in fluid communication. The container-side flow passage 42 is open in the suction container 2 and communicates with the suction port 7 through the interior of the suction container 2.

Figure 3:
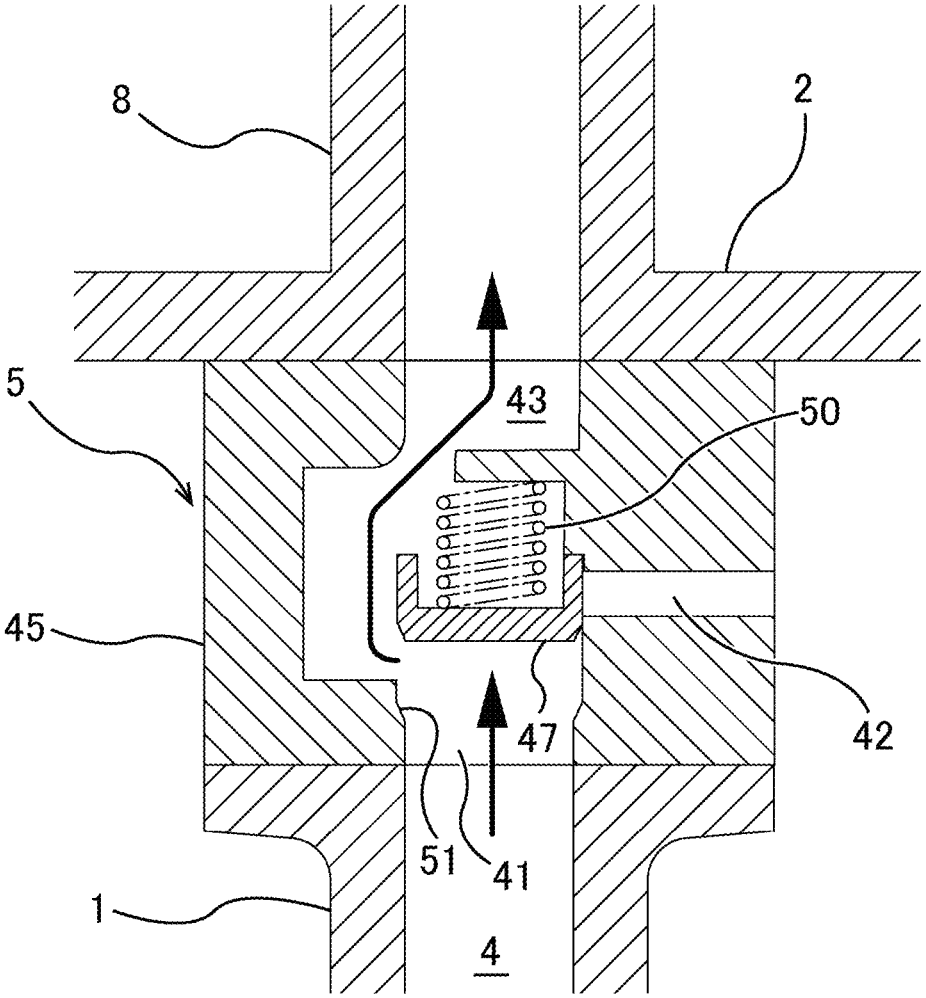
FIG. 3 is a diagram showing a state of the flow-path switching device when a submersible pump is in operation.

FIG. 3 shows a state of the flow-path switching device 5 when the submersible pump 1 is in operation. When the submersible pump 1 is in operation, the liquefied gas is discharged from the discharge outlet 4 of the submersible pump 1 and flows into the pump-side flow passage 41 of the flow-path switching device 5. The liquefied gas flowing through the pump-side flow passage 41 moves the valve element 47 against the force of the spring 50, thus opening the pump-side flow passage 41 and closing the container-side flow passage 42 with the valve element 47. As a result, the fluid communication between the pump-side flow passage 41 and the outlet flow passage 43 is established.

When the operation of the submersible pump 1 is stopped, the valve element 47 is pressed against the valve seat 51 by the spring 50. As a result, as shown in FIG. 2, the pump-side flow passage 41 is closed, while the container-side flow passage 42 and the outlet flow passage 43 communicate with each other. In this way, the flow-path switching device 5 of this embodiment operates only by the spring 50 and the flow of liquefied gas.

Figure 4:
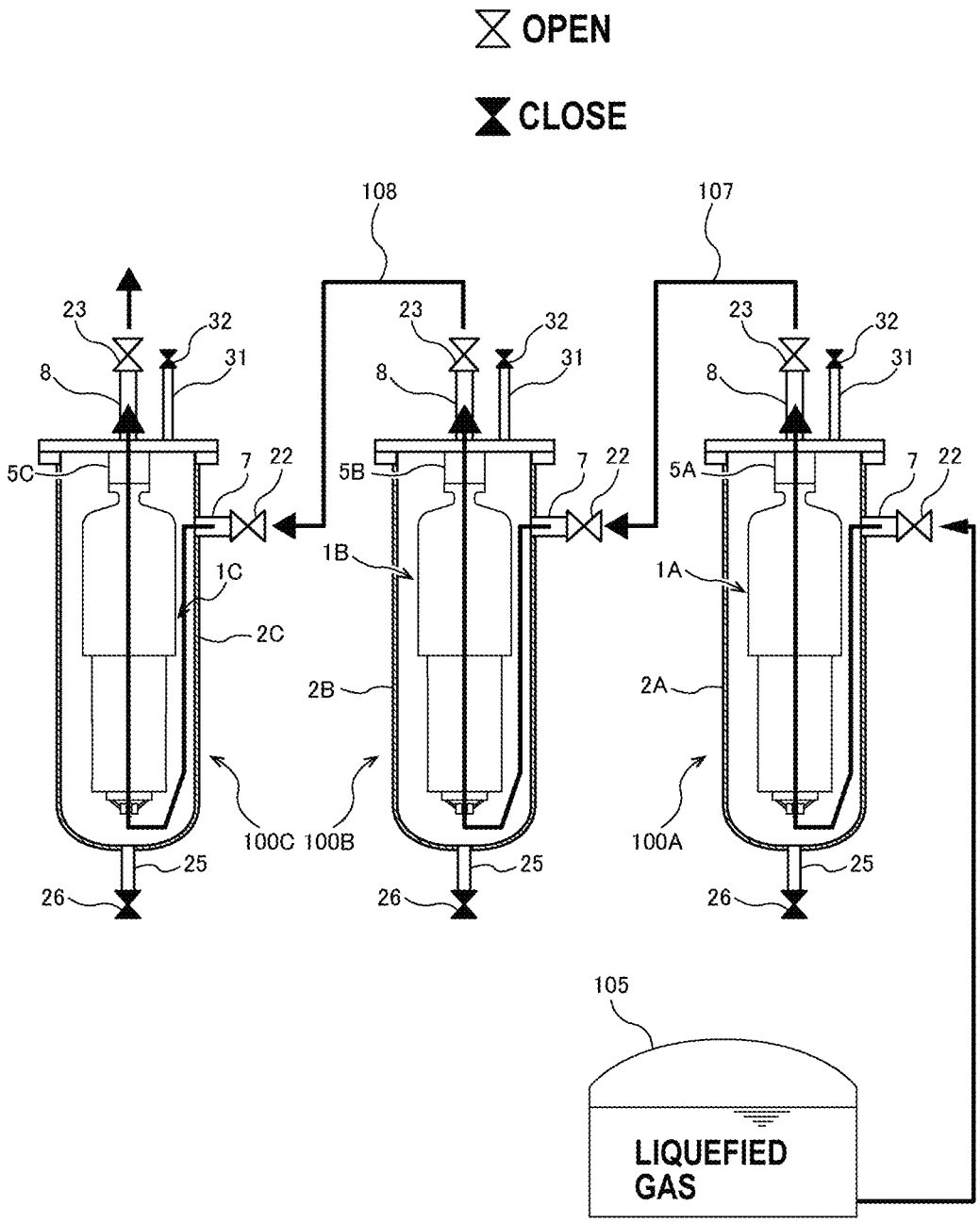
FIG. 4 is a schematic diagram showing one embodiment of a pump system having multiple pump apparatuses coupled in series.

In order to pressurize the liquefied gas to a target pressure required by a user, a plurality of pump apparatuses 100 may be coupled in series. FIG. 4 is a schematic diagram showing an embodiment of a pump system including a plurality of pump apparatuses 100A, 100B, and 100C coupled in series. In FIG. 4, the plurality of pump apparatuses 100A, 100B, and 100C have the same configuration as the pump apparatus 100 described with reference to FIGS. 1 to 6. In the following description, submersible pump, suction container, and flow-path switching device of the pump apparatus 100A are referred to as submersible pump 1A, suction container 2A, and flow-path switching device 5A, respectively. Submersible pump, suction container, and flow-path switching device of the pump apparatus 100B are referred to as submersible pump 1B, suction container 2B, and flow-path switching device 5B, respectively. Submersible pump, suction container, and flow-path switching device of the pump apparatus 100C are referred to as submersible pump 1C, suction container 2C, and flow-path switching device 5C, respectively.

The pump apparatus 100A is disposed upstream of the pump apparatus 100B, which is disposed upstream of the pump apparatus 100C. The suction port 7 of the pump apparatus 100A is coupled to a liquefied-gas storage tank 105 in which the liquefied gas is stored. The pump apparatus 100A is coupled in series to the pump apparatus 100B by a communication line 107, and the pump apparatus 100B is coupled in series to the pump apparatus 100C by a communication line 108. More specifically, the discharge port 8 of the pump apparatus 100A is coupled to the suction port 7 of the pump apparatus 100B by the communication line 107, and the discharge port 8 of the pump apparatus 100B is coupled to the suction port 7 of the pump apparatus 100C by the communication line 108.

The submersible pumps 1A, 1B, and 1C are coupled in series in the order of the submersible pump 1A, the submersible pump 1B, and the submersible pump 1C. The liquefied gas is successively pressurized by these submersible pumps 1A, 1B, and 1C. When the submersible pumps 1A, 1B, and 1C are in operation and transferring the liquefied gas, the flow-path switching devices 5A, 5B, and 5C are in the state shown in FIG. 3.

Next, an embodiment of a method of starting the submersible pumps 1A, 1B, and 1C coupled in series as shown in FIG. 4 will be described. The submersible pumps 1A, 1B, and 1C are started in sequence in the order from the upstream side. Specifically, the submersible pump 1A is started first, then the submersible pump 1B is started, and finally the submersible pump 1C is started.

Figure 5:
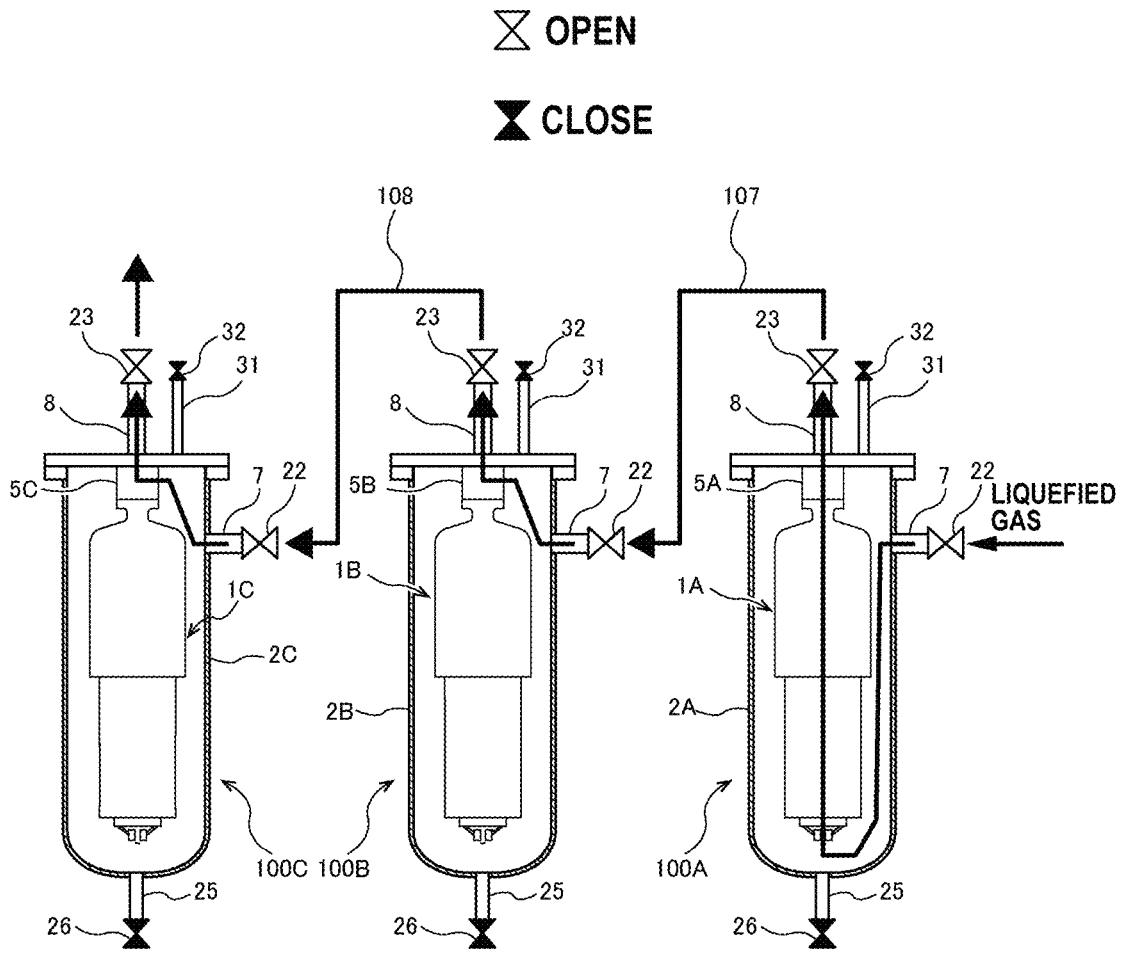
FIG. 5 is a diagram explaining one embodiment of a method of sequentially starting the multiple submersible pumps shown in FIG. 4.

FIG. 5 is a diagram illustrating a state in which the submersible pump 1A is started while the submersible pumps 1B and 1C are not in operation. When the submersible pump 1A is started, the liquefied gas is delivered by the submersible pump 1A through the flow-path switching device 5A to the suction container 2B of the pump apparatus 100B. When the submersible pump 1A is in operation and is delivering the liquefied gas, the flow-path switching device 5A is in the state shown in FIG. 3.

At this stage, since the submersible pump 1B is not in operation, the flow-path switching device 5B is in the state shown in FIG. 2. Therefore, the liquefied gas passes through the flow-path switching device 5B while bypassing the submersible pump 1B (i.e., the liquefied gas does not flow through the submersible pump 1B). The liquefied gas is further delivered from the pump apparatus 100B to the suction container 2C of the pump apparatus 100C. Since the submersible pump 1C is also not in operation, the flow-path switching device 5C is in the state shown in FIG. 2. Therefore, the liquefied gas passes through the flow-path switching device 5C while bypassing the submersible pump 1C (i.e., the liquefied gas does not flow through the submersible pump 1C).

Figure 6:
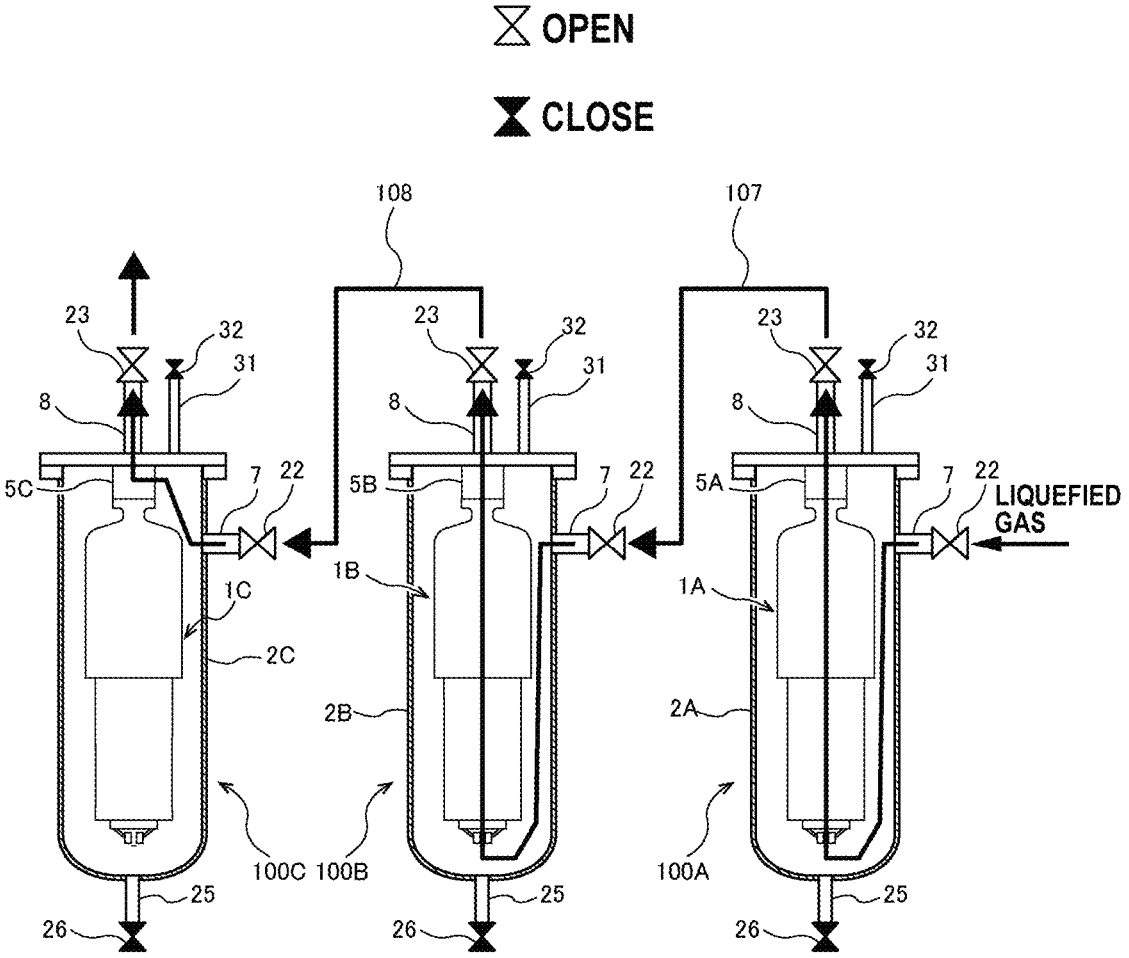
FIG. 6 is a diagram explaining the above-mentioned embodiment of the method of sequentially starting the multiple submersible pumps shown in FIG. 4.

Next, the submersible pump 1B is started. FIG. 6 is a diagram illustrating a state in which the submersible pump 1B is started while the submersible pump 1A is operating, and the submersible pump 1C is not operating. When the submersible pump 1B is started, the liquefied gas is transferred by the submersible pump 1B through the flow-path switching device 5B to the suction container 2C of the pump apparatus 100C. When the submersible pump 1B is operating and transferring the liquefied gas, the flow-path switching device 5B is in the state shown in FIG. 3.

At this stage, since the submersible pump 1C is still not in operation, the flow-path switching device 5C is in the state shown in FIG. 2. Therefore, the liquefied gas passes through the flow-path switching device 5C while bypassing the submersible pump 1C (i.e., the liquefied gas does not flow through the submersible pump 1C).

Next, the submersible pump 1C is started. When the submersible pump 1C is started, the submersible pumps 1A and 1B are in operation. The state in which all of the submersible pumps 1A, 1B, and 1C are in operation is shown in FIG. 4. In this manner, the submersible pumps 1A, 1B, and 1C are started in sequence in the order from the upstream side.

When the submersible pumps 1A, 1B, and 1C are started, each flow-path switching device can allow the liquefied gas to bypass the submersible pump that is not in operation. Therefore, the impellers of the submersible pump that is not in operation do not rotate, and as a result, damage to sliding parts of the submersible pump, such as the bearings, can be prevented.

Next, an embodiment of a method of stopping the operations of the submersible pumps 1A, 1B, and 1C coupled in series as shown in FIG. 4 will be described. The operations of the submersible pumps 1A, 1B, and 1C are stopped in sequence in the order from the downstream side. Specifically, first, the operation of the submersible pump 1C is stopped, then the operation of the submersible pump 1B is stopped, and finally the operation of the submersible pump 1A is stopped.

Figure 7:
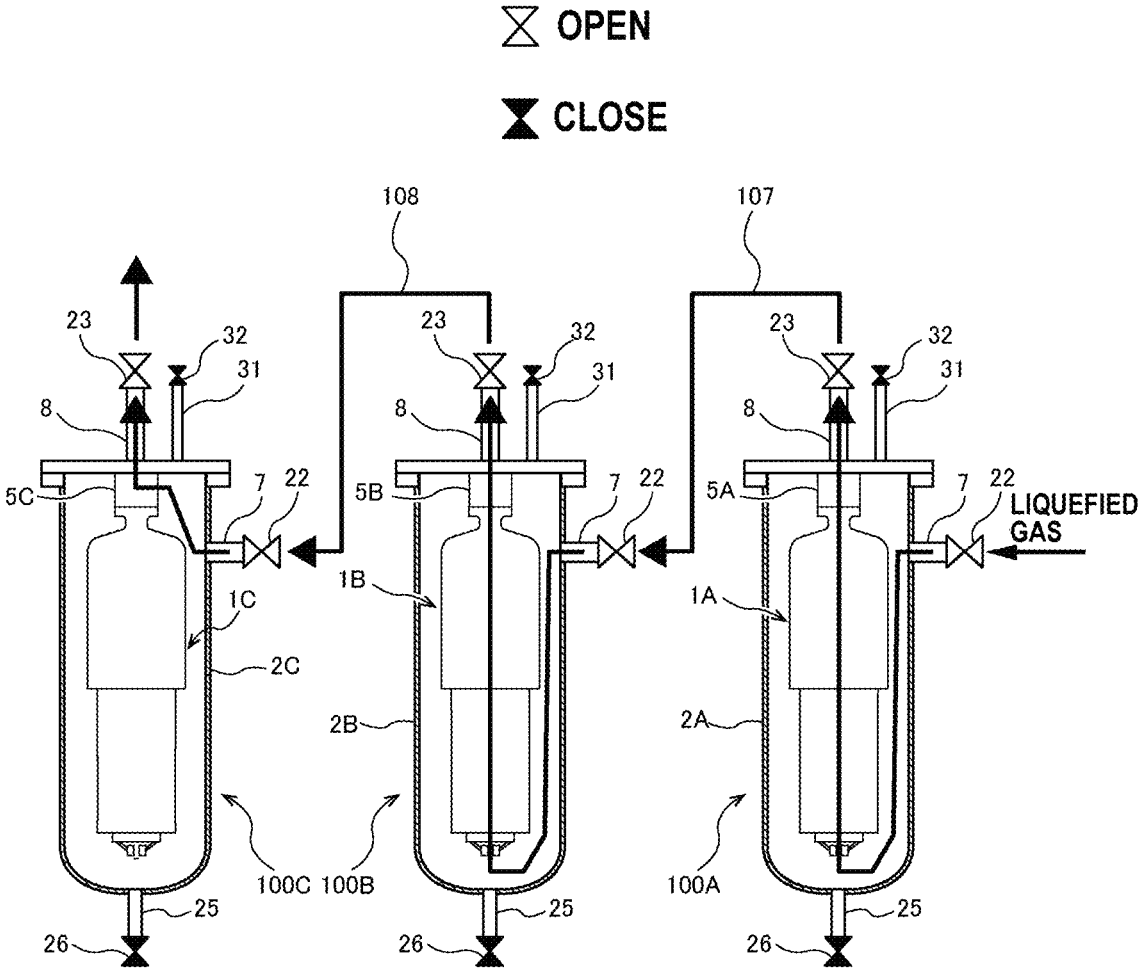
FIG. 7 is a diagram explaining one embodiment of the method of sequentially stopping operations of the multiple submersible pumps shown in FIG. 4.

FIG. 7 is a diagram illustrating a state in which the operation of the submersible pump 1C is stopped and the submersible pumps 1A and 1B are in operation. When the submersible pump 1C has been stopped, the flow-path switching device 5C is in the state shown in FIG. 2. Therefore, the liquefied gas passes through the flow-path switching device 5C while bypassing the submersible pump 1C (i.e., the liquefied gas does not flow through the submersible pump 1C).

At this stage, the submersible pumps 1A and 1B are in operation. Therefore, the liquefied gas is delivered by the submersible pump 1A through the flow-path switching device 5A to the suction container 2B of the pump apparatus 100B, and the liquefied gas is further delivered by the submersible pump 1B through the flow-path switching device 5B to the suction container 2C of the pump apparatus 100C. When the submersible pumps 1A and 1B are in operation and are delivering the liquefied gas, the flow-path switching devices 5A and 5B are in the state shown in FIG. 3.

Figure 8:
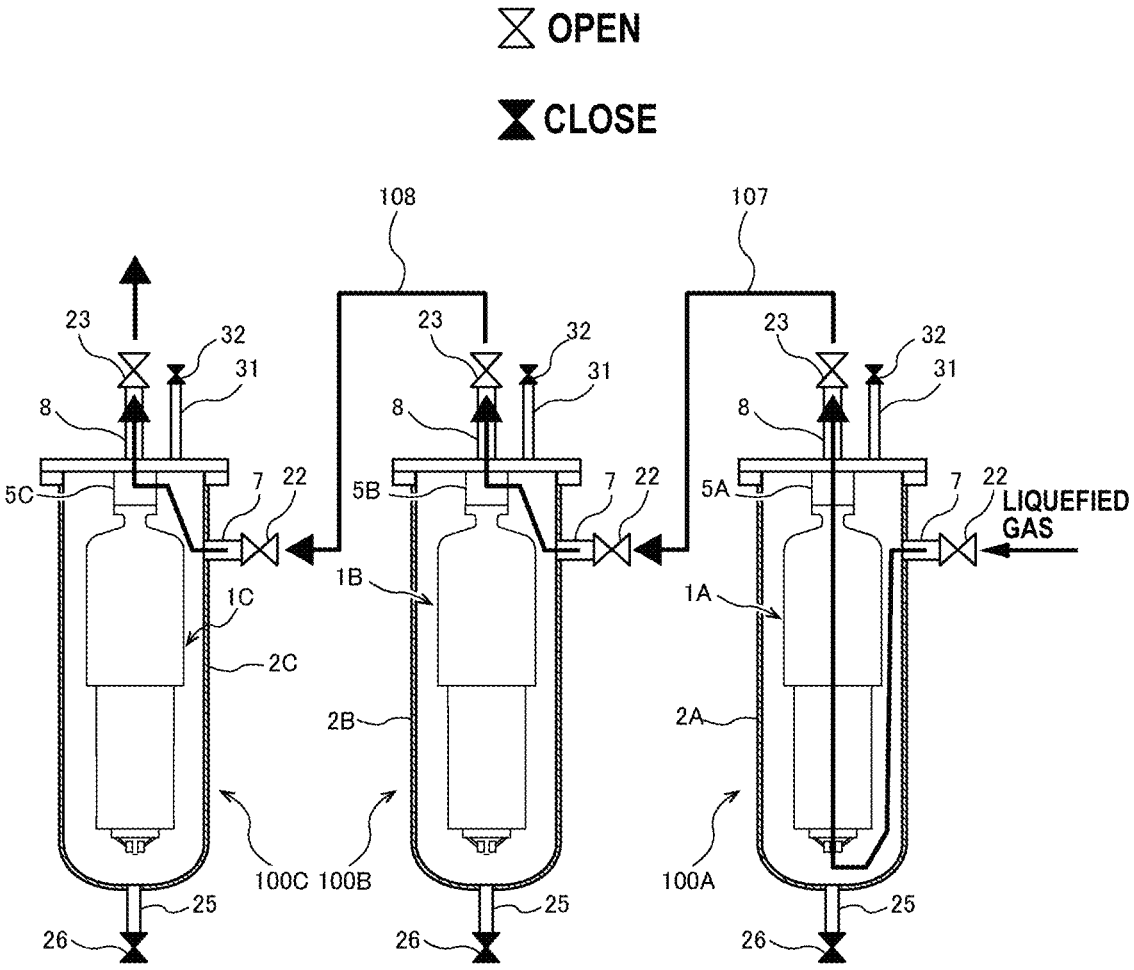
FIG. 8 is a diagram explaining the above-mentioned embodiment of the method of sequentially stopping the operations of the multiple submersible pumps shown in FIG. 4.

Next, the submersible pump 1B is stopped. FIG. 8 is a diagram illustrating a state in which the submersible pump 1B is stopped while the submersible pump 1A is operating and the submersible pump 1C is not operating. When the submersible pump 1B has been stopped, the flow-path switching device 5B is in the state shown in FIG. 2. Therefore, the liquefied gas passes through the flow-path switching device 5B while bypassing the submersible pump 1B (i.e., the liquefied gas does not flow through the submersible pump 1B).

At this stage, since the submersible pump 1A is still in operation, the flow-path switching device 5A is in the state shown in FIG. 3. Therefore, the liquefied gas is delivered by the submersible pump 1A through the flow-path switching device 5A to the suction container 2B of the pump apparatus 100B.

Next, the submersible pump 1A is stopped. When the submersible pump 1A is stopped, the submersible pumps 1B and 1C are not in operation. In this manner, the submersible pumps 1A, 1B, and 1C are stopped in sequence in the order from the downstream side.

When the submersible pumps 1A, 1B, and 1C are not in operation, the flow-path switching devices can allow the liquefied gas to bypass the submersible pumps that are not in operation. Therefore, the impellers of the submersible pumps that are not in operation do not rotate, and as a result, damage to the sliding parts of the submersible pumps, such as the bearings, can be prevented.

The embodiment of the pump system shown in FIGS. 4 to 8 includes three pump apparatuses 100A, 100B, and 100C coupled in series, while the number of pump apparatuses is not limited to this embodiment. In one embodiment, the pump system may include only two pump apparatuses coupled in series, or may include four or more pump apparatuses coupled in series. The multiple submersible pumps coupled in series are started and stopped in the same manner as in the above-described embodiment.

Figure 9:
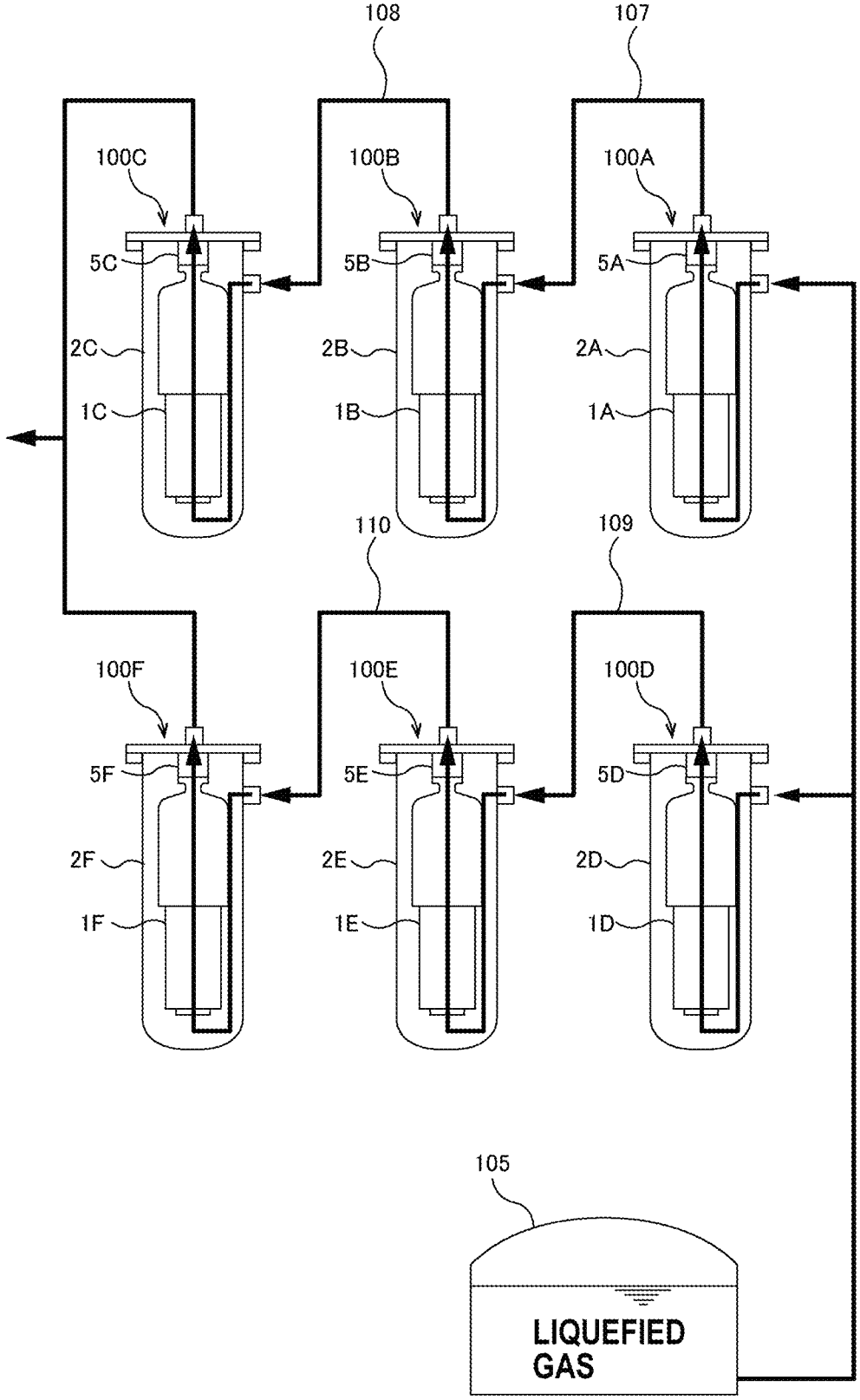
FIG. 9 is a schematic diagram showing another embodiment of a pump system having multiple pump apparatuses coupled in series.

FIG. 9 is a schematic diagram showing another embodiment of a pump system including a plurality of pump apparatuses coupled in series. Configuration and operation of this embodiment that will not be specifically described are the same as those of the embodiment described with reference to FIG. 7, and therefore duplicated description will be omitted. The pump system of the embodiment shown in FIG. 9 further includes pump apparatuses 100D, 100E, and 100F coupled in series, in addition to the pump apparatuses 100A, 100B, and 100C coupled in series.

The pump apparatus 100D includes a suction container 2D, a submersible pump 1D disposed in the suction container 2D, and a flow-path switching device 5D disposed in the suction container 2D. The pump apparatus 100E includes a suction container 2E, a submersible pump 1E disposed in the suction container 2E, and a flow-path switching device 5E disposed in the suction container 2E. The pump apparatus 100F includes a suction container 2F, a submersible pump 1F disposed in the suction container 2F, and a flow-path switching device 5F disposed in the suction container 2F.

The pump apparatus 100D is coupled in series to the pump apparatus 100E by a communication line 109, and the pump apparatus 100E is coupled in series to the pump apparatus 100F by a communication line 110. More specifically, a discharge port of the pump apparatus 100D is coupled to a suction port of the pump apparatus 100E by the communication line 109, and a discharge port of the pump apparatus 100E is coupled to a suction port of the pump apparatus 100F by the communication line 110.

The pump apparatuses 100D, 100E, and 100F are arranged in parallel with the pump apparatuses 100A, 100B, and 100C. The pump apparatuses 100A, 100B, 100C, 100D, 100E, and 100F have the same configuration as the pump apparatus 100 described with reference to FIGS. 1 to 3, and therefore duplicated descriptions thereof will be omitted. The pump apparatuses 100A and 100D are coupled to the liquefied-gas storage tank 105 in which the liquefied gas is stored. According to the embodiment shown in FIG. 9, the liquefied gas is pumped by the submersible pumps 1A to 1C of the pump apparatuses 100A to 100C and by the submersible pumps 1D to 1F of the pump apparatuses 100D to 100F arranged in parallel.

The submersible pumps 1D, 1E, and 1F are started in sequence in the order from the upstream side, as well as the submersible pumps 1A, 1B, and 1C. Specifically, the submersible pump 1D is started first, then the submersible pump 1E is started, and finally the submersible pump 1F is started.

The submersible pumps 1D, 1E, and 1F are stopped in sequence in the order from the downstream side, as well as the submersible pumps 1A, 1B, and 1C. Specifically, the submersible pump 1F is stopped first, then the submersible pump 1E is stopped, and finally the submersible pump 1D is stopped.

Figure 10:
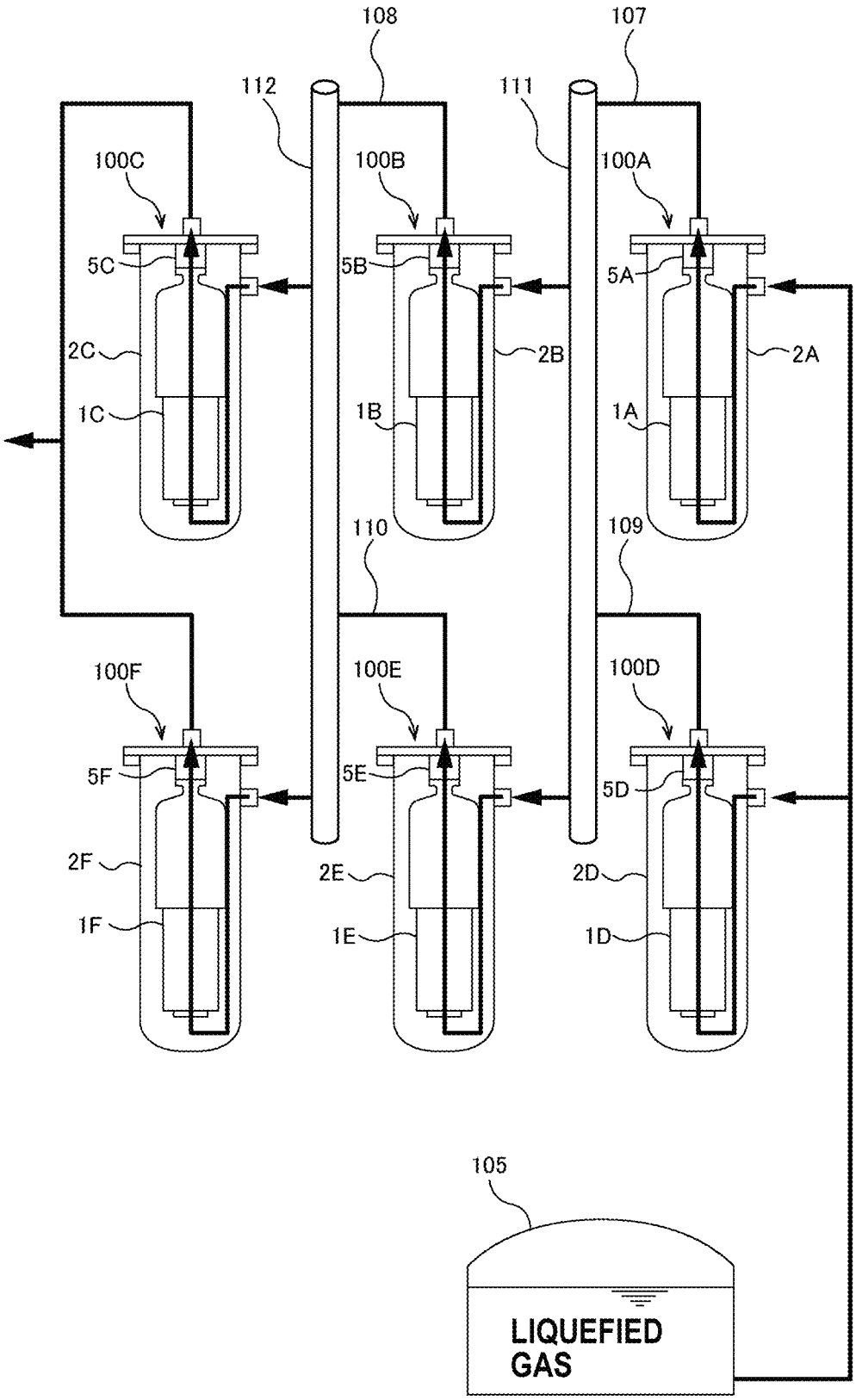
FIG. 10 is a schematic diagram showing yet another embodiment of a pump system having multiple pump apparatuses coupled in series.
Figure 11:
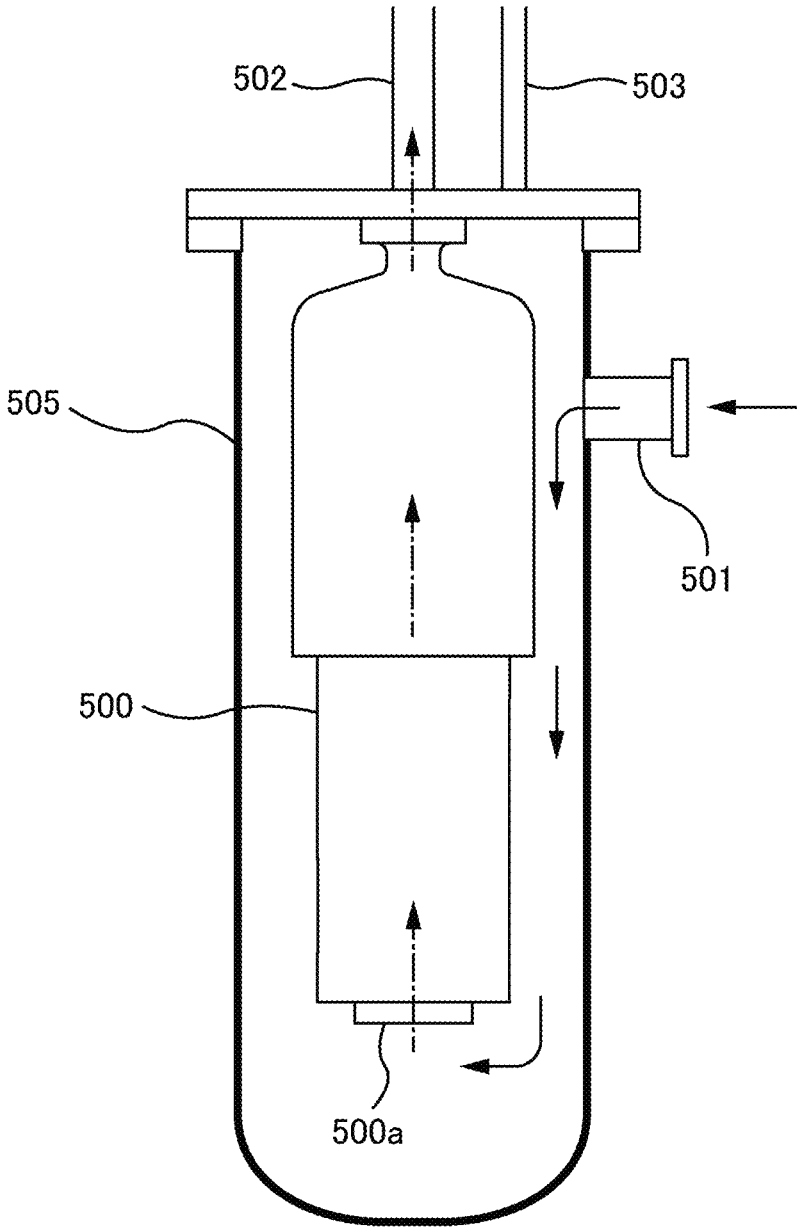
FIG. 11 is a schematic diagram showing a conventional example of a pump apparatus for pumping liquefied gas.
Figure 12:
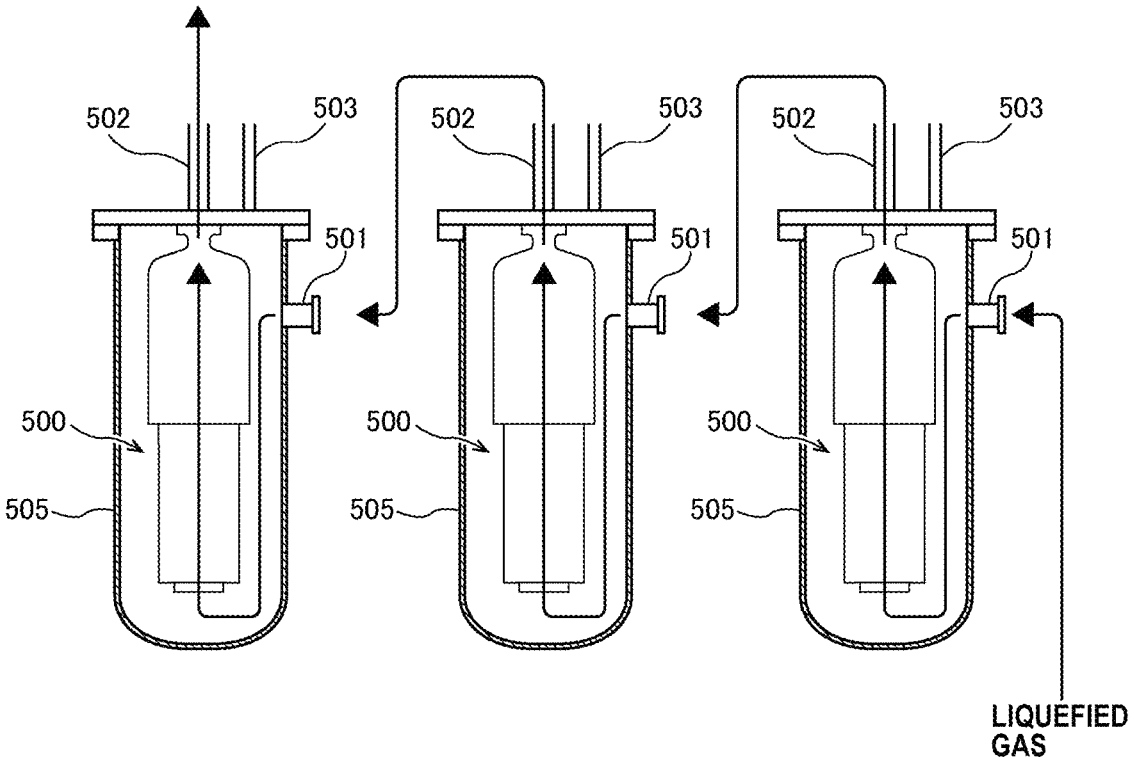
FIG. 12 is a schematic diagram showing an example of a plurality of pump apparatuses coupled in series.

FIG. 10 is a schematic diagram showing yet another embodiment of a pump system including a plurality of pump apparatuses coupled in series. Configuration and operation of this embodiment that will not be specifically described are the same as those of the embodiment described with reference to FIG. 9, and therefore repetitive description will be omitted. In the embodiment shown in FIG. 10, the communication line 107 coupling the pump apparatus 100A to the pump apparatus 100B is coupled to the communication line 109 coupling the pump apparatus 100D to the pump apparatus 100E by an intermediate header 111. In addition, the communication line 108 coupling the pump apparatus 100B to the pump apparatus 100C is coupled to the communication line 110 coupling the pump apparatus 100E to the pump apparatus 100F by an intermediate header 112.

As in the above-described embodiments, the submersible pumps 1A, 1B, and 1C are started in sequence in the order from the upstream side, and the submersible pumps 1D, 1E, and 1F are also started in sequence in the order from the upstream side. The operations of the submersible pumps 1A, 1B, and 1C are stopped in sequence in the order from the downstream side, and the operations of the submersible pumps 1D, 1E, and 1F are also stopped in sequence in the order from the downstream side.

The pump apparatuses 100A to 100C are also coupled in series to the pump apparatuses 100D to 100F by the intermediate headers 111, 112. As a result, various flows of the liquefied gas are formed, allowing various operations of the pump apparatuses 100A to 100C and the pump apparatuses 100D to 100F. For example, it is possible to stop the operation of the pump apparatus 100C or the pump apparatus 100F for maintenance or depending on the pressure required by a user.

In the pump system shown in FIGS. 9 and 10, two rows of pump apparatuses 100A to 100C and pump apparatuses 100D to 100F are provided in parallel, while three or more rows of pump apparatuses may be provided in parallel.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a method of starting and stopping a submersible pump used for delivering liquefied gas, such as liquid hydrogen, liquid nitrogen, liquefied ammonia, liquefied natural gas, liquefied ethylene gas, or liquefied petroleum gas.

| Reference Signs List | |
|---|---|
| 1, 1A, 1B, 1C, 1D, 1E, 1F | submersible pump |
| 2, 2A, 2B, 2C, 2D, 2E, 2F | suction container |
| 3 | suction inlet |
| 4 | discharge outlet |
| 5, 5A, 5B, 5C, 5D, 5E, 5F | flow-path switching device |
| 7 | suction port |
| 8 | discharge port |
| 9 | motor rotor |
| 10 | motor stator |
| 11 | electric motor |
| 12 | rotation shaft |
| 14 | bearing |
| 15 | impeller |
| 16 | pump casing |
| 17 | discharge flow path |
| 22 | suction valve |
| 23 | discharge valve |
| 25 | drain line |
| 26 | drain valve |
| 31 | vent line |
| 32 | vent valve |
| 41 | pump-side flow passage |
| 42 | container-side flow passage |
| 43 | outlet flow passage |
| 45 | flow-passage structure |
| 47 | valve element |
| 50 | spring |
| 51 | valve seat |
| 100, 100A, 100B, 100C, 100D, 100E, 100F | pump apparatus |
| 105 | liquefied-gas storage tank |
| 107, 108, 109, 110 | communication line |
| 111, 112 | vacuum line |

The invention claimed is:

1. A method of starting a plurality of pump apparatuses including at least a first pump apparatus and a second pump apparatus coupled in series, comprising:

starting a first submersible pump disposed in a first suction container of the first pump apparatus to deliver liquefied gas through a first flow-path switching device in the first suction container to a second suction container of the second pump apparatus;

passing the liquefied gas through a second flow-path switching device in the second suction container while the liquefied gas bypasses a second submersible pump disposed in the second suction container; and then starting the second submersible pump.

2. The method according to claim 1, wherein each of the first flow-path switching device and the second flow-path switching device includes:

a flow-passage structure having a pump-side flow passage, a container-side flow passage, and an outlet flow passage; and a valve element arranged in the flow-passage structure, the valve element being configured to allow the outlet flow passage to selectively communicate with either the pump-side flow passage or the container-side flow passage, the pump-side flow passage communicating with a discharge outlet of the corresponding submersible pump, the container-side flow passage communicating with an interior of the corresponding suction container, and the outlet flow passage communicating with a discharge port of the corresponding suction container.

3. The method according to claim 2, wherein each of the first flow-path switching device and the second flow-path switching device further includes a spring that presses the valve element against the flow-passage structure to close the pump-side flow passage.

4. The method according to claim 1, wherein the plurality of pump apparatuses further include a third pump apparatus and a fourth pump apparatus coupled in series, the third pump apparatus and the fourth pump apparatus are arranged in parallel with the first pump apparatus and the second pump apparatus, and the third pump apparatus and the fourth pump apparatus have the same configuration as the first pump apparatus and the second pump apparatus.

5. The method according to claim 4, wherein a communication line that couples the first pump apparatus to the second pump apparatus is coupled to a communication line that couples the third pump apparatus to the fourth pump apparatus by an intermediate header.

6. A method of stopping operations of a plurality of pump apparatuses including at least a first pump apparatus and a second pump apparatus coupled in series, comprising:

while a first submersible pump arranged in a first suction container of the first pump apparatus is delivering liquefied gas through a first flow-path switching device in the first suction container to a second suction container of the second pump apparatus, stopping operation of a second submersible pump arranged in the second suction container;

passing the liquefied gas through a second flow-path switching device in the second suction container while the liquefied gas bypasses the second submersible pump; and then stopping operation of the first submersible pump.

7. The method according to claim 6, wherein each of the first flow-path switching device and the second flow-path switching device includes:

a flow-passage structure having a pump-side flow passage, a container-side flow passage, and an outlet flow passage; and a valve element arranged in the flow-passage structure, the valve element being configured to allow the outlet flow passage to selectively communicate with either the pump-side flow passage or the container-side flow passage, the pump-side flow passage communicating with a discharge outlet of the corresponding submersible pump, the container-side flow passage communicating with an interior of the corresponding suction container, and the outlet flow passage communicating with a discharge port of the corresponding suction container.

8. The method according to claim 7, wherein each of the first flow-path switching device and the second flow-path switching device further includes a spring that presses the valve element against the flow-passage structure to close the pump-side flow passage.

9. The method according to claim 6, wherein the plurality of pump apparatuses further include a third pump apparatus and a fourth pump apparatus coupled in series, the third pump apparatus and the fourth pump apparatus are arranged in parallel with the first pump apparatus and the second pump apparatus, and the third pump apparatus and the fourth pump apparatus have the same configuration as the first pump apparatus and the second pump apparatus.

10. The method of claim 9, wherein a communication line that couples the first pump apparatus to the second pump apparatus is coupled to a communication line that couples the third pump apparatus to the fourth pump apparatus by an intermediate header.

* * * * *